US006814081B2

(12) United States Patent
Hasler

(10) Patent No.: US 6,814,081 B2
(45) Date of Patent: Nov. 9, 2004

(54) POCKET ASHTRAY

(76) Inventor: Josef Hasler, Bächis 18, CH-9452 Hinterforst (CH)

( * ) Notice: Subject to any disclaimer, the term of this patent is extended or adjusted under 35 U.S.C. 154(b) by 0 days.

(21) Appl. No.: 10/279,021

(22) Filed: Oct. 24, 2002

(65) Prior Publication Data

US 2003/0098031 A1 May 29, 2003

(30) Foreign Application Priority Data

Oct. 24, 2001 (CH) ..... 1959/01

(51) Int. Cl.[7] ..... A24F 19/14

(52) U.S. Cl. ..... 131/235.1; 131/236; 131/256; 131/329; 206/246; 220/253; 220/259.3

(58) Field of Search ..... 220/253, 200, 220/259.3, 230; 131/236, 235.1, 256, 329, 237.5; 206/246

(56) References Cited

U.S. PATENT DOCUMENTS

| | | | | |
|---|---|---|---|---|
| 2,320,647 | A | 6/1943 | Phillips | |
| 2,559,254 | A | 7/1951 | Lundstrom | |
| 2,638,240 | A | 5/1953 | Lundstrom | |
| 5,673,709 | A | 10/1997 | Brothers | |
| 5,927,285 | A | 7/1999 | Lozano et al. | |
| 6,170,490 | B1 * | 1/2001 | Barrow | 131/236 |

FOREIGN PATENT DOCUMENTS

| | | | |
|---|---|---|---|
| DE | 30 07 254 | * | 9/1981 |
| DE | 295 04 095 U1 | | 9/1995 |
| DE | 296 20 481 U1 | | 5/1997 |
| DE | 299 01 661 U1 | | 6/1999 |
| DE | 200 18 982 U1 | | 2/2001 |
| FR | 2 801 475 A1 | | 6/2001 |
| JP | 10-84936 | * | 4/1998 |

* cited by examiner

*Primary Examiner*—Dionne A. Walls
(74) *Attorney, Agent, or Firm*—Foley & Lardner LLP

(57) ABSTRACT

A pocket ashtray consists of at least one hollow body (2, 10) having a cap (1, 9) rotatably fastened on its end surface (s). An orifice (**2*b*, 10*b*) and a depression (2*a*, 10*b*) are present in the end surface (S) of the hollow body (2, 10); either an orifice (1*a*) is provided in the cap (1) or the cap (9) is specially shaped. By suitable, successive rotation of the cap (1, 9), it is possible to stub out a smoking article (5) in the depression (2*a*, 10*a***) and then to load it into the interior of the pocket ashtray and store it away from dirt.

16 Claims, 4 Drawing Sheets

POCKET ASHTRAY

Figure 1A:
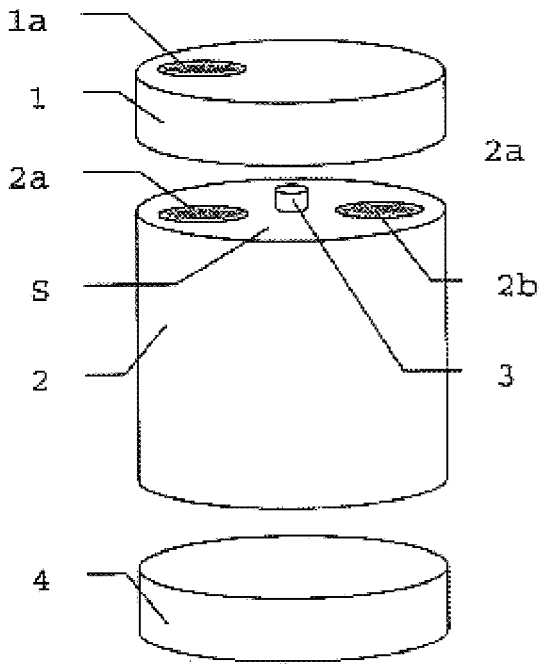

The invention relates to a pocket ashtray.

Pocket ashtrays for extinguishing burning smoking articles, by which commercial forms of smoking tobacco, such as, for example, cigars, cigarettes or cigarillos, are to be understood below, have long been known. These devices are generally used in activities where conventional ashtrays are not available and either soiling of the environment is to be avoided in principle or still glowing residues of smoking articles may give rise to danger, for example where there is an existing fire hazard. In addition, pocket ashtrays now have the status of an accessory which, for example, in a refined design, is regarded as a necessary accessory or serves as a gift, in particular as a give-away.

In the simplest form, these pocket ashtrays consist of a metal bowl which only permits a smoking article to be stubbed out. Improved forms also include the possibility of holding ash or other residues of smoked articles. These solutions generally comprise a hinged housing which in principle resembles a cigarette case. An example of this is shown in U.S. Pat. No. 5,927,285. Owing to the large orifice forming during use, the user may be contaminated through environmental influences, such as, for example, wind or rain. Furthermore sealing is relatively difficult and the locking mechanisms are generally relatively complicated.

A simple solution comprising a tube which can be closed by screwing on a cap is disclosed in Utility Model DE 296 20 481 U. Disadvantages prove to be the lack of possibility for extinguishing smoking articles and the necessity of having to unscrew the cap from the tube in each case for use, which requires a comparatively large number of turns of the cap and hence results in limited ease of handling.

Utility Model DE 200 18 982 U describes a cylindrical pocket ashtray which consists of two metal sleeves which can be pushed one into the other and which each have a longitudinal slot. By turning the sleeve, the slots can be made to coincide and the introduction of ash and smoking articles is possible. However, owing to the necessity of having to introduce smoking articles parallel to the longitudinal axis of the container, the size of the slots is relatively large, with the result that the disadvantages described above occur. A separate possibility for extinguishing embers is not disclosed.

U.S. Pat. No. 5,673,709 describes a cylindrical pocket ashtray having an orifice in an end surface, which can be closed by a separate, spring-loaded flap. In addition, an embodiment for holding a lighter is described. A possibility for extinguishing embers is not described.

Thus, pocket ashtrays of the prior art have the disadvantage that they either have relatively large orifices with the disadvantages described above or rely on separate flaps for closing smaller orifices. Pocket ashtrays having only a single interior moreover have the disadvantage that either the embers have to be extinguished outside the pocket ashtray, which in turn gives rise to contamination and ignition problems, or extinguishing of the embers takes place in the interior, in which flammable or still consumable residues of smoking articles may then also be stored. However, a frequent requirement of smokers is precisely to extinguish only partly smoked cigarettes or cigars and to continue smoking them later on after safe storage.

The object of the present invention is to provide a pocket ashtray which is simple to handle and provides only small orifices dimensioned according to the smoking articles to be received or to be extinguished, so that contamination of the environment as well as effects of materials present in the interior of the pocket ashtray are minimized under all weather conditions.

A further object is to minimize the number of required components of the pocket ashtray while providing a surface design which is as smooth and hook-free as possible.

These objects are achieved, according to the invention, by the characterizing features of claims 1 and 3, respectively.

Advantageous and alternative designs and further developments of the pocket ashtray are evident from the features of the further dependent claims.

Because the pocket ashtray has a closable depression for stubbing out smoking articles, it is possible to store partly smoked articles free from dirt and with minimum danger of ignition.

The invention is based on the concept of minimizing the dimensions of an orifice in the end face of a hollow body suitable for receiving smoking articles. Closing is effected by turning a cap provided with an identical orifice or a specially shaped cap, with the result that the requirement for complicated closing mechanisms is dispensed with.

The formation of an additional depression in the same end surface of the hollow body permits separate extinguishing of the embers of a smoking article, separately from the interior of the hollow body. Access to this depression is ensured in turn through the orifice in the cap or its special shape, it being necessary for this purpose only to turn the cap to a different position.

Figure 1B:
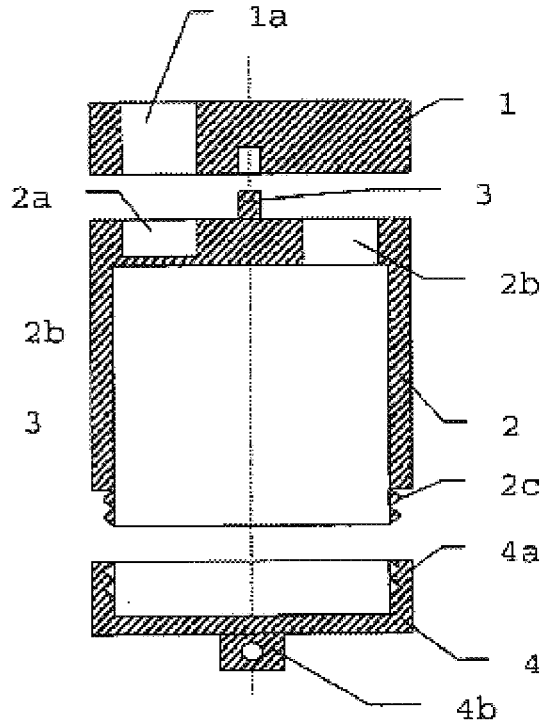
Figure 2:
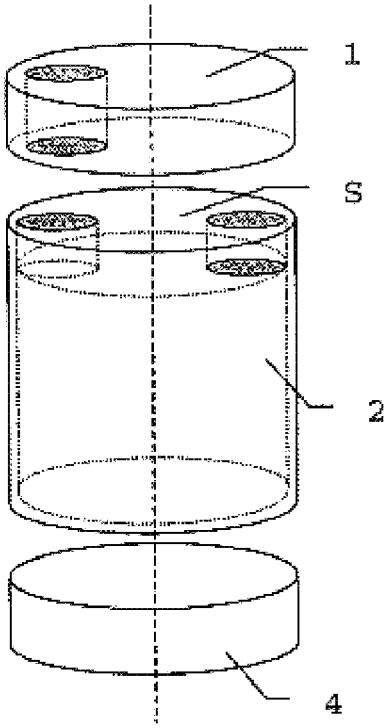
Figures 4A, 4B, 4C:
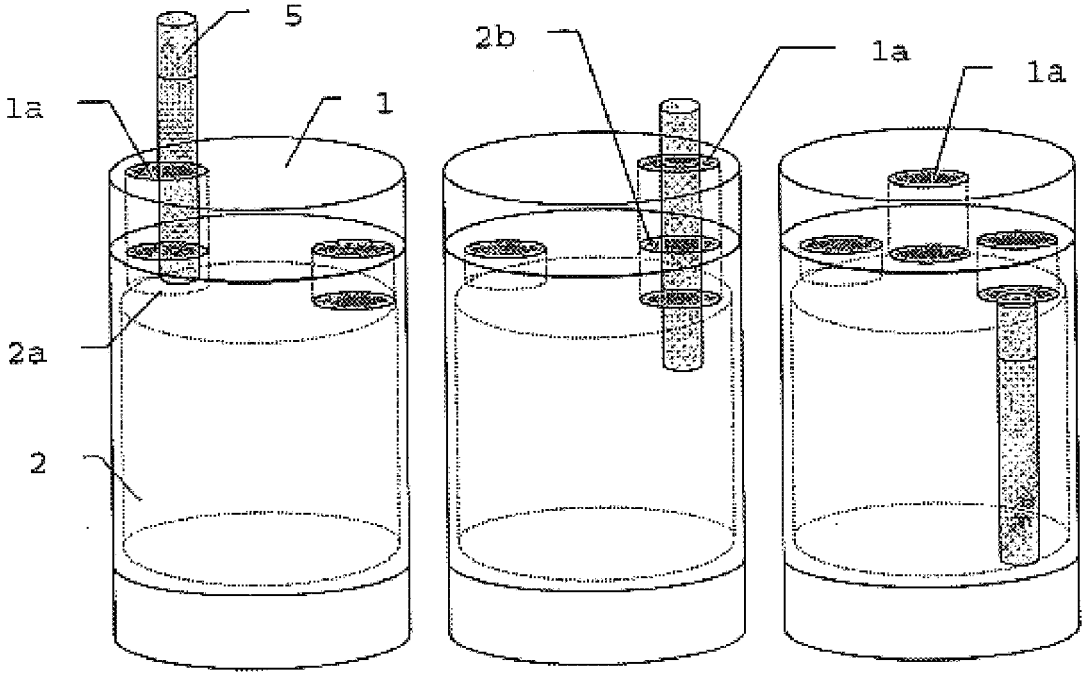
Figures 5A, 5B, 5C:
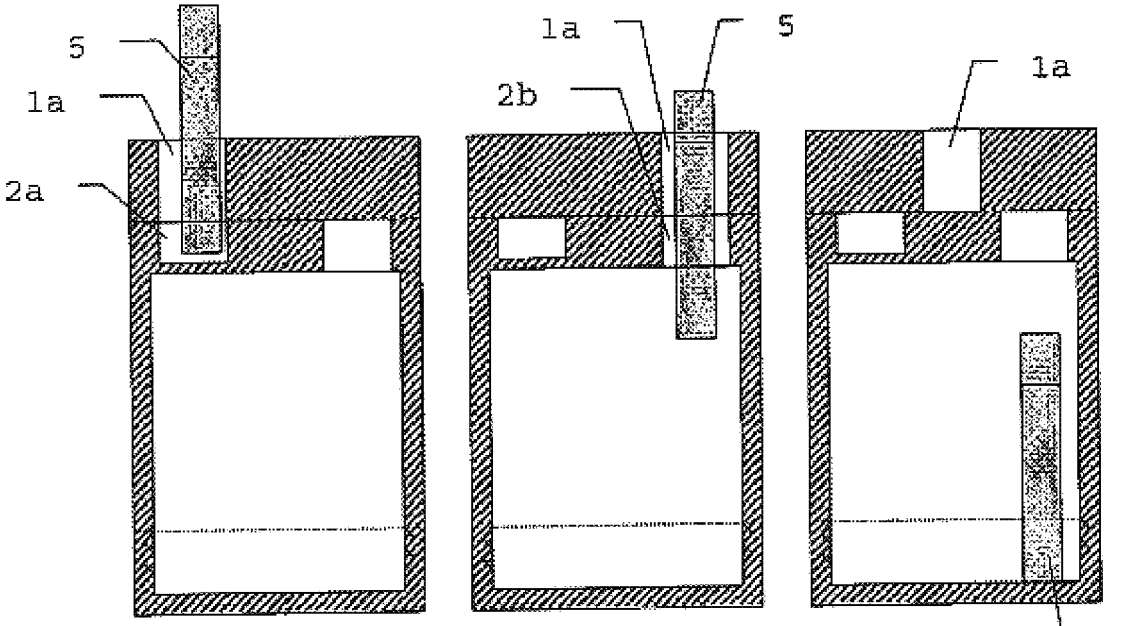

The pocket ashtray according to the invention is described in more detail below, purely by way of example, with reference to embodiments shown schematically in the drawing. Specifically, FIG. 1*a* shows a schematic overall view of the exemplary embodiment of a pocket ashtray according to the invention, together with its components;

FIG. 1*b* shows a corresponding sectional view along the longitudinal axis;

FIG. 2 shows a schematic view of the orifices in the components of a pocket ashtray according to the invention;

FIGS. 3*a–d* show the various possible positions of the cap;

FIGS. 4*a–c* show an exemplary use of the pocket ashtray according to the invention for extinguishing a cigarette and for receiving the residues;

FIGS. 5*a–c* show the same use in a corresponding sectional view along the longitudinal axis;

FIGS. 6*a–d* show schematic views of the securing of the cap positions by locking elements.

Figure 7:
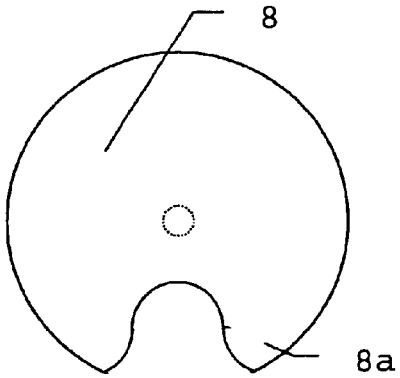
Figures 8A, 8B, 8C:
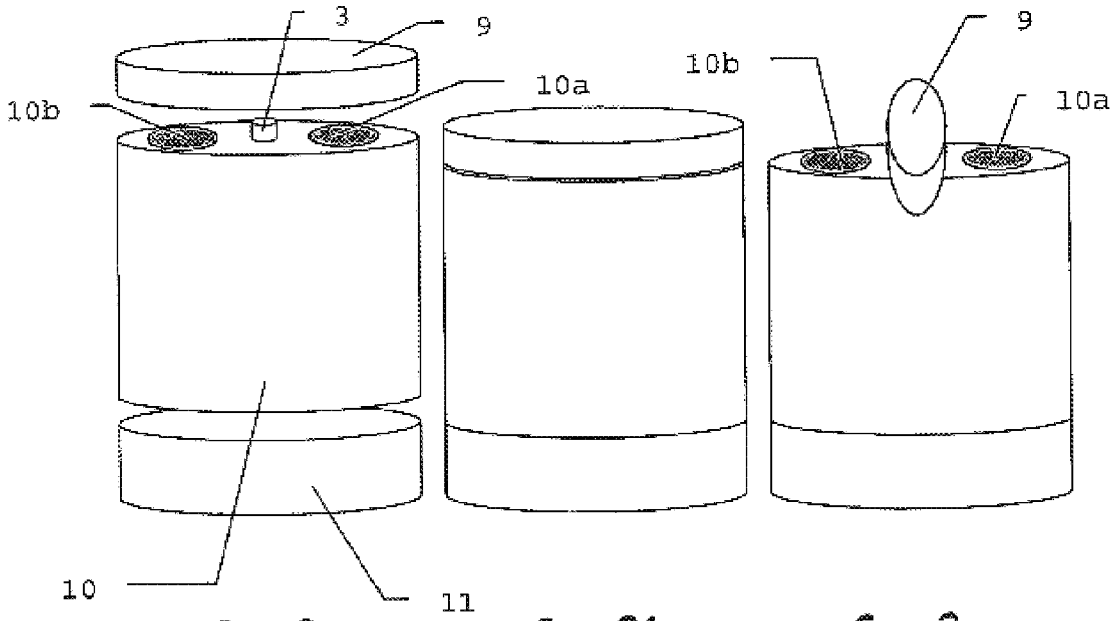

FIG. 7 shows an alternative embodiment of the pocket ashtray according to the invention, with specially shaped caps, and FIGS. 8*a–c* show an alternative embodiment of the pocket ashtray according to the invention, having an oval cross-section.

FIG. 1*a* schematically shows the components of the exemplary embodiment of a pocket ashtray according to the invention. The pocket ashtray has a cylindrical hollow body 2 and a cap 1 which is mounted on the end surface S of the hollow body 2. The connection of cap 1 and hollow body 2 is effected here, purely by way of example, via an axle 3 which projects from the end surface S. The bottom of the hollow body 2 is closed by a lid 4. The use of such a lid permits easy access to the interior of the hollow body 2 and hence easy removal of ash and uncombusted components of the smoking articles.

A cylindrical bore is introduced as orifice 1*a* through the cap 1, the diameter of which bore is chosen so that generally customary smoking articles can be readily passed through.

Present in the end surface of the hollow body 2 are a depression 2*a* and a cylindrical bore as orifice 2*b*, which continues into the interior of the hollow body 2. The diameter and shape of the orifices are determined in turn by the dimensions of commercial smoking articles, and the orifices need not be identical either in shape or in dimensions. A design in which the orifices differ from one another is described further below.

The same components, cap 1, hollow body 2 and lid 4, are shown in sectional view in FIG. 1*b*. The two orifices 1*a* and 2*b* lead as bores completely through cap 1 and end surface S, respectively, whereas the depression 2*a* is only in the form of a countersunk bore. In this specific embodiment, the hollow body 2 has an external thread 2*c* and the lid 4 an internal thread 4*a*, with the aid of which the two components can be connected tightly and in a manner able to withstand tough conditions of use. An eye 4*b*, in particular a folding or retractable one, is mounted on the outside of the lid 4 in order to be able to fasten the pocket ashtray to an object, for example a bunch of keys or a chain.

FIG. 2 once again clearly shows the bores and orifices in the components cap 1, hollow body 2 and lid 4. The exact position of the bores may vary in other embodiments. Their relative position depends in particular on the dimension of the component and on the smoking articles to be used. Thus, it is also possible, for example in the case of comparatively large pocket ashtrays, to make all bores in the hollow body 2 within a quadrant on the end surface S. The position of the bores is thus dependent on the intended handling, here in particular the required angle of rotation between the different positions, and on the mechanical conditions.

FIG. 3 shows the various relative positions of the cap 1. The basis of the handling shown is an arrangement of orifices or bores as illustrated in FIG. 1 and FIG. 2. The orifices in the hollow body are located on opposite sides. In principle, however, other arrangements according to the invention can also be realized.

Figure 3A:
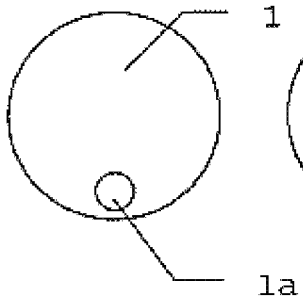

FIG. 3*a* shows a first position of the cap as a starting position. The orifice 1*a* of the cap 1 is oriented in a manner such that all orifices in the hollow body are covered by the cap. The orifice 1*a* thus coincides with a part of the end surface which has no bore. In this position, the pocket ashtray is closed tightly, preferably air-tight, from the outside and it is possible to transport the pocket ashtray without it losing ash or giving rise to the danger of ignition of a flammable surrounding material.

Figure 3C:
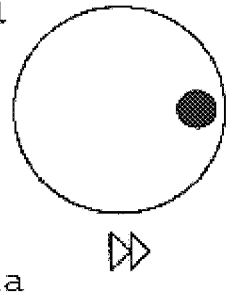
Figure 3B:
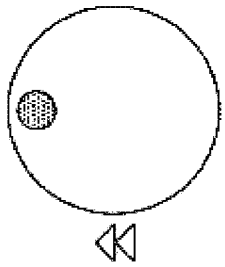

A clockwise rotation through 90° leads to the third position which is shown in FIG. 3*b* and in which the orifice 1*a* of the cap and the depression in the hollow body coincide. The user can now insert a glowing smoking article, for example a cigarette or a cigarillo, through the cap and stub it out in the depression.

A further, counterclockwise rotation through 180° closes the depression, so that ash residues present therein cannot contaminate the environment, and causes the orifice of the cap to coincide with the continuous orifice in the hollow body. This second position is shown in FIG. 3*c*. The completely or partly smoked article can now be passed through the resulting orifice into the interior of the hollow body. In this position, removal of smoking articles which have not yet been completely smoked is also possible, so that, after safe storage in the interior of the hollow body, later complete consumption is possible.

Figure 3D:
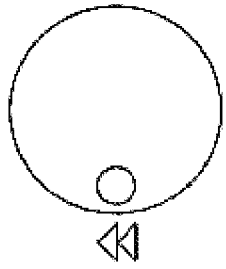

A final clockwise rotation through 90°, shown in FIG. 3*d*, once again leads to the first position and hence to complete closure of all orifices of the hollow body.

The process shown purely schematically in FIGS. 3*a–d* by the positions of the cap is shown pictorially in FIGS. 4*a–c* for clarity.

FIG. 4*a* shows the stubbing out of a cigarette 5 in the third position of the cap. The cigarette 5 is passed through the orifice 1*a* in the cap 1, which orifice is brought into coincidence with the depression 2*a*. The embers can be extinguished or at least scraped off by stubbing out in the depression 2*a*. Turning the cap closes the depression from the outside, and the ash is stored without danger of contamination of surrounding materials. In particular, contamination or ignition of incompletely smoked articles is substantially ruled out by the separate storage of the embers or their still incompletely extinguished ash.

The second position shown in FIG. 4*b* permits introduction of the cigarette 5 into the interior of the hollow body through the orifices 1*a* and 2*b* which have been brought into coincidence.

The establishing of transportability after turning the orifice 1*a* of the cap back into the first position is shown in FIG. 4*c*.

FIGS. 5*a–c* show the same process in a sectional view.

FIGS. 6*a–d* show a possible specification of positions. In order to permit safe handling with reliable positioning of the cap even in darkness, the individual positions can be defined by catch elements. Thus, for example, the second and third positions in the above example can be provided with stops which permit a rotational movement only up to the angle defined by them and thus safely fix the respective position. The fixing of the cap in its respective position is effected by the friction of one or more O-rings 6*a*, 6*b* which simultaneously provide a seal with respect to the outside. The number and position of the O-rings 6*a*, 6*b* depend in particular on the specific design of the cap 1 and of the hollow body 2.

Figure 6A:
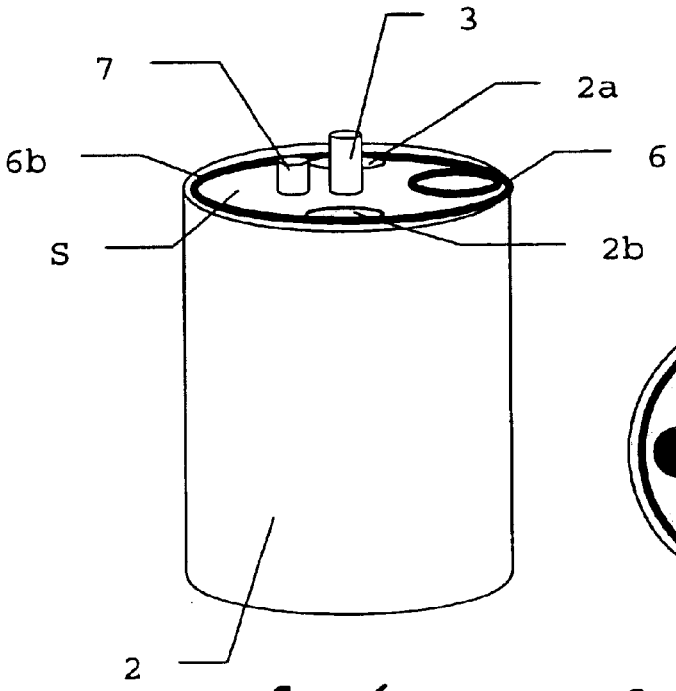
Figure 6B:
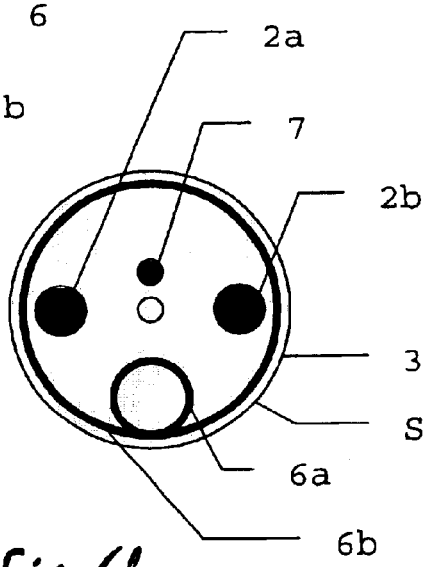

FIG. 6*a* shows an exemplary hollow body 2 having all elements mounted on its end face S. In addition to orifice 2*b*, the depression 2*a* and the axle 3, two O-rings 6*a* and 6*b* and a shape 7 are provided. This end surface S with all elements is shown in plan view in FIG. 6*b*.

Figure 6C:
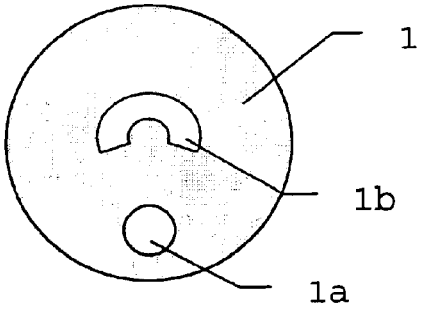

FIG. 6*c* shows that side of the cap 1 which faces the end surface, said cap being shown with the orifice 1*a* and a groove 1*b*.

Figure 6D:
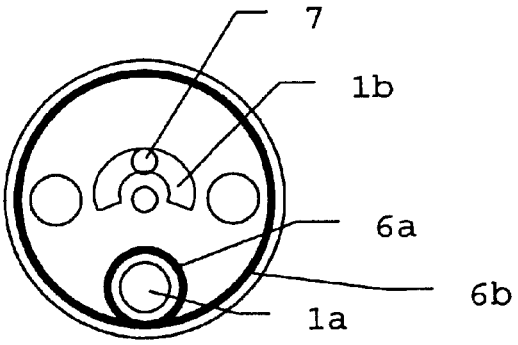

The cooperation of all elements is shown schematically in FIG. 6*d*. In the first position, the orifice 1*a* in the cap 1 is covered by the O-ring 6*a*, and the orifice 2*b* and the depression 2*a* of the hollow body are sealed by the O-ring 6*b* and the cap 1. The second and third positions are fixed by the contact of the shape 7 with the two ends of the groove 1*b* provided in the cap 1, when the cap 1 is turned.

FIG. 7 shows an alternative design of the cap 8, in which the orifice is in the form of a recess 8*a* in the edge. This recess 8*a* has the advantage of permitting safe gripping and turning of the cap even under adverse handling conditions, such as, for example, cold or wet fingers.

FIGS. 8*a–c* shows an alternative implementation of the pocket ashtray, having an oval cross-section.

FIG. 8*a* shows the individual components cap 9, hollow body 10 and a lid 11 which closes the hollow body 10 at the bottom. The hollow body once again has a depression 10*a* and an orifice 10*b*. All components have the same oval cross-section, and the cap 9 is rotatable about an axle 3 relative to the hollow body 10.

FIG. 8 shows the pocket ashtray with its cap in the first position. All orifices are closed off from the environment.

By turning the cap 9 through 90°, the depression 10*a* and the orifice 10*b* are exposed equally. In this special embodiment, the second and third positions are thus identical.

Of course, the figures shown represent one of many embodiments, and a person skilled in the art is able to derive alternative implementations, for example with the use of other exterior or interior geometries of the components used.

What is claimed is:

1. A pocket ashtray comprising:

a hollow body configured to receive at least one of ash and smoking articles; and a cap substantially coinciding with an end surface of the hollow body, the end surface and the cap each having at least one orifice which is suitable for the passage of said at least one of ash and smoking articles, wherein the cap is fastened to the hollow body so as to be rotatable relative to the hollow body in such a way that, in a first position, the cap closes the orifice of the hollow body and, in a second position, the orifices of the cap and hollow body coincide, and wherein the hollow body has a depression configured for stubbing out said smoking articles in its end surface, the cap being fastened so as to be rotatable relative to the hollow body in such a way that, in a third position, the orifice of the cap coincides with the depression.

2. The pocket ashtray as claimed in claim 1, wherein the hollow body has, on its side opposite the cap, a further orifice which can be closed by a removable lid.

3. The pocket ashtray as claimed in claim 2, wherein said lid is unscrewable.

4. The pocket ashtray as claimed in claim 1, comprising a ring or an eye as a fastening device.

5. The pocket ashtray as claimed in claim 1, wherein a change from the second position to the third position is effected by turning the cap through 180°.

6. The pocket ashtray as claimed in claim 1, wherein a change from the first position to the second position is effected by turning the cap through 90°.

7. The pocket ashtray as claimed in claim 1, wherein at least one O-ring is arranged between the hollow body and cap.

8. The pocket ashtray as claimed in claim 1, wherein the cap is fastened so as to be rotatable relative to the hollow body in such a way that at least one of the positions is defined by a stop device.

9. The pocket ashtray as claimed in claim 8, wherein the stop device is formed by a shape guided in a groove.

10. The pocket ashtray as claimed in claim 1, wherein said hollow body is cylindrical.

11. The pocket ashtray as claimed in claim 1, wherein said hollow body is of one-piece construction.

12. A pocket ashtray comprising:

a hollow body having a substantially oval cross-section and configured to receive at least one of ash and smoking articles; and a cap substantially coinciding with an end surface of the hollow body and having a substantially oval cross-section, the end surface having at least one orifice which is suitable for the passage of said at least one of ash and smoking articles, wherein the cap is fastened to the hollow body so as to be rotatable relative to the hollow body via an axle which perpendicularly projects from the end surface in such a way that the cap closes the orifice of the hollow body in a first position and does not cover the orifice of the hollow body in a second position.

13. The pocket ashtray as claimed in claim 12, wherein said hollow body is of one-piece construction.

14. A pocket ashtray comprising:

a hollow body having a substantially oval cross-section and configured to receive at least one of ash and smoking articles; and a cap substantially coinciding with an end surface of the hollow body and having a substantially oval cross-section, the end surface having at least one orifice which is suitable for the passage of said at least one of ash and smoking articles, wherein the cap is fastened to the hollow body so as to be rotatable relative to the hollow body in such a way that the cap closes the orifice of the hollow body in a first position and does not cover the orifice of the hollow body in a second position, wherein the hollow body has, in its end surface, a depression configured for stubbing out said smoking articles, the cap being fastened so as to be rotatable relative to the hollow body in such a way that, in a third position, the cap does not cover the depression.

15. The pocket ashtray as claimed in claim 14, wherein the second and third positions are identical.

16. A pocket ashtray comprising:

a hollow body having a substantially oval cross-section and configured to receive at least one of ash and smoking articles; and a cap substantially coinciding with an end surface of the hollow body and having a substantially oval cross-section, the end surface having at least one orifice which is suitable for the passage of said at least one of ash and smoking articles, wherein the cap is fastened to the hollow body so as to be rotatable relative to the hollow body in such a way that the cap closes the orifice of the hollow body in a first position and does not cover the orifice of the hollow body in a second position, wherein the cap is fastened so as to be rotatable relative to the hollow body via an axle which projects from the end surface.

* * * * *